US005715581A

United States Patent [19]

Akeno

[11] Patent Number: 5,715,581

[45] Date of Patent: Feb. 10, 1998

[54] HOOK STRUCTURE FOR A MOLDED SURFACE FASTENER

[75] Inventor: Mitsuru Akeno, Toyama-ken, Japan

[73] Assignee: YKK Corporation, Tokyo, Japan

[21] Appl. No.: 528,529

[22] Filed: Sep. 14, 1995

[30] Foreign Application Priority Data

Sep. 20, 1994 [JP] Japan ..... 6-224589

[51] Int. Cl.[6] ..... A44B 18/00

[52] U.S. Cl. ..... 24/452; 24/449; 24/442

[58] Field of Search ..... 24/442, 447, 448, 24/449, 450, 452

[56] References Cited

U.S. PATENT DOCUMENTS

D. 374,609 10/1996 Akeno .
D. 374,813 10/1996 Akeno .
4,984,339 1/1991 Provost et al. ..... 24/452
5,131,119 7/1992 Murasaki et al. ..... 24/452
5,339,499 8/1994 Kennedy et al. ..... 24/452
5,361,462 11/1994 Murasaki ..... 24/442 X
5,457,856 10/1995 Murasaki ..... 24/452

FOREIGN PATENT DOCUMENTS 0 642 749 3/1995 European Pat. Off. .
0 698 352 2/1996 European Pat. Off. .

*Primary Examiner*—Jose V. Chen
*Assistant Examiner*—Hanh V. Tran
*Attorney, Agent, or Firm*—Hill, Steadman & Simpson

[57] ABSTRACT

In a molded surface fastener, a hook structure has on at least one surface of a stem an upright reinforcing rib extending from the base of the stem to part of a hook-shape engaging portion. The reinforcing rib projects upwardly with respect to the rear surface of the hook-shape engaging portion and terminates in an apex whose height is smaller than the height of the apex of the hook-shape engaging portion and greater than the height of the line tangential to the hook-shape engaging portion at the tip and substantially parallel to the upper surface of the substrate sheet.

11 Claims, 8 Drawing Sheets

HOOK STRUCTURE FOR A MOLDED SURFACE FASTENER

BACKGROUND OF THE INVENTION

1. Field of the Invention

This invention relates to a molded surface fastener in which a multiplicity of hooks are molded on a substrate sheet by extrusion or injection molding using thermoplastic synthetic resin, and more particularly to a molded hook structure which has both adequate softness and strength of monofilament and is very durable, thus securing a high engaging rate, though the hooks are made by molding.

2. Description of the Related Art

Surface fasteners of the type in which hooks are formed by weaving monofilaments in a woven cloth so as to form loop piles of monofilaments and then cutting the loop piles are well known in the art. This type surface fastener has softness of a woven cloth and softness of monofilament and is characterized by that the hooked surface fastener comes into engagement with and are peeled off loops of a companion surface fastener with a very smooth touch. Moreover, since the monofilaments constituting the hooks are treated by drawing, the surface fastener is excellent in pulling strength and bending strength even in a small cross-sectional area. Further, since the surface fastener can have a very high density of hooks depending on the woven structure, it is possible to secure a high engaging rate and an adequate degree of durability. However, with the woven type surface fastener, since consumption of material and a number of processing steps are large, it is difficult to reduce the cost of production.

For an improvement, a molded type surface fastener was developed in which a substrate sheet and hooks are formed integrally and simultaneously by extrusion or injection molding. Typical examples of molding technology for this type surface fastener are disclosed in, for example, U.S. Pat. No. 3,312,583 and WO 87/06522. Briefly described, as a rotary drum in which a number of molding disks each having on an outer peripheral edge of each of opposite surfaces a number of hook-forming cavities and a number of spacer disks each having flat surfaces are alternately superimposed one over another is rotated, the hooks formed in the cavities are removed off the drum along with the substrate sheet. The spacer disks are disposed between the molding disks because the cavities of the whole shape of the hooks cannot be made in one mold due to the shape of the hooks.

However, in the molded type surface fastener, partly since a delicate shape cannot be obtained as compared to the woven type surface fastener due to the technical difficulty of the molding process, and partly since the formed hooks are poor in orientation of molecules, only a very low degree of strength can be achieved with the same size of the monofilament hooks. Therefore none of the conventional molded type surface fasteners are satisfactory for practical use. Further, according to the conventional hook structure, the individual stem is simple in cross-sectional shape and would hence tend to fall flat from its base. As a result, the individual stems would not restore their original posture after repeated use, thus lowering the rate of engagement with loops of a companion surface fastener. Therefore, in order to secure desired strength, it is absolutely necessary to increase the size of the individual hooks, which makes the hooks rigid and the number of hooks per unit area (density of hooks) reduced to lower the rate of engagement with the companion loops. As a solution, a new hook structure which enables a smooth touch, with the stem hardly falling flat, during the engaging and peeling operation like the weave type surface fastener, and which increases the rate of engagement to secure adequate strength and durability is disclosed in, for example, U.S. Pat. No. 5,131,119. In the molded type surface fastener disclosed in this U.S. Patent, as shown in FIGS. 13 and 14 of the accompanying drawings, each hook 10' has a hook-shape engaging portion 12' extending forwardly from the distal end of a stem 11' which has a rear surface **11*a*' rising obliquely in a smooth curve from a substrate sheet 15' and a front surface 11*b*' rising upwardly from the substrate sheet 15', and a reinforcing rib 13' projecting from a side surface of the stem 11', the cross-sectional area of the hook 10' increasing gradually from a tip of the hook-shape engaging portion 12' toward the base of the stem 11'. The reinforcing rib 13' serves to prevent the stem 11' from falling laterally and also enables to minimize the size of the stem 11' and the hook-shape engaging portion 12' while securing a required degree of engaging strength. The height of the reinforcing rib 13' from the substrate sheet 15' is substantially equal to a half of the height of the tip of the hook-shape engaging portion 12' directed downwardly, from the substrate sheet 15'**.

U.S. Pat. No. 5,339,499 also discloses a hook structure in which a reinforcing rib having the same thickness as that of a hook and extending upwardly beyond the tip of a hook-like engaging portion is situated on one side surface of the hook.

However, according to U.S. Pat. No. 5,131,119, because of the above-mentioned shape of the reinforcing rib 13', both the hook-shape engaging portion 12' and the part of the stem 11' above the apex of the reinforcing rib 13' tend to bend laterally when the surface fastener is depressed by a companion surface fastener with a force larger than the flexual rigidity of the hook during the engaging operation, and if the entire hook is minimized in size and has a very high flexibility, whole of the hook-shape engaging portion 12' is flexed forwardly so as to be depressed so that it cannot come into engagement with a loop 20, which may lower the engaging rate of the entire surface fastener.

Further, the shape of the reinforcing rib disclosed in U.S. Pat. No. 5,339,499 is identical with the shape of the hook excluding engaging portion as seen in side view. The whole shape of the hook corresponds to the shape in which one of laterally divided halves of a single hook-shape engaging portion is removed. Specifically, in the conventional molded hook structure devoid of a reinforcing rib, the hook except the stem and a base of the hook-shape engaging portion is laterally divided into halves, and one half is removed to reduce the thickness of the hook-shape engaging portion. Thus the hook-shape engaging portion is reduced to half in thickness and is hence deformable while the stem has the same degree of rigidity as conventional.

According to the hook structure disclosed in U.S. Pat. No. 5,339,499, when the surface fastener is depressed by a companion surface fastener during the engaging operation, the hook-shape engaging portion tends to bend laterally and to be flexed forwardly. Particularly when only the hook-shape engaging portion is flexed forwardly, the opening of the hook-shape engaging portion is closed so that the hook-shape engaging portion cannot be engaged with a loop.

SUMMARY OF THE INVENTION

It is therefore an object of this invention to provide a hook structure, for a surface fastener, which has an adequate degree of durability for repeated use while preventing the hook from excessively falling laterally and forwardly for securing a high rate of engagement with a loop of the companion surface fastener even though a hook and especially a hook-shape engaging portion has an adequate degree of softness.

According to this invention, there is provided a molded surface fastener comprising: a substrate sheet; and a multiplicity of hooks molded on and projecting from one surface of the substrate sheet; each of the hooks being composed of i) a stem having a rear surface rising obliquely in a smooth curve from the substrate sheet, a front surface rising upwardly from the substrate sheet, ii) a hook-shape engaging portion extending in a curve forwardly from a distal end of the stem, and iii) a first reinforcing rib situated on at least one side surface of the stem. The first reinforcing rib rises perpendicularly from the substrate sheet. The first reinforcing rib has an apex projecting upwardly with respect to a rear surface of the hook-shape engaging portion, the apex of the reinforcing rib having a height less than or at most equal to that of an apex of the hook-shape engaging portion.

Preferably, the apex of the first reinforcing rib is situated above a line tangential to the hook-shape engaging portion at the tip and substantially parallel to the upper surface of the substrate sheet, and each hook has a second reinforcing rib situated at the base end of the first reinforcing rib and having a height less than or at most equal to that of the first reinforcing rib. Further, each hook may have a third reinforcing rib situated at another side surface of the stem. Furthermore, every adjacent pair of the hooks may be connected with each other by part of the first reinforcing rib or by part of the second and third reinforcing ribs.

In use, because of the first to third reinforcing ribs, the hook is prevented from falling laterally. When the hooks are depressed from the upper side by a companion surface fastener having loops, the hook-like engaging portion is slightly inclined forwardly initially until the substrate sheet of the companion surface fastener comes into contact with the apex of the first reinforcing rib, after which the substrate sheet is supported by the first reinforcing rib to keep the hook-shape engaging portion in engagement with the loop as the hook-shape engaging portion is prevented from further inclination. Further, since the thus slightly inclined hook-like engaging portion becomes smaller in radius of curvature, the loop once engaged with the hook-like engaging portion would become difficult to disengage from it.

Further, the first reinforcing rib is effective also at the time of molding the surface fastener having the hook structure of this invention. Specifically, when the hooks molded integrally with the substrate sheet are removed off the mold cavities in the peripheral surface of the rotary drum as the drum is rotated, the hook-shape engaging portion of the individual hook is removed substantially straight. As a result, after this removing, the hook-shape engaging portions do not restore their arcuate shape same as the shape of the cavities and have a slightly straight shape. In an attempt to correct such a hook shape into a desired arcuate shape, it has been a conventional practice to heat the surface fastener after molding and to depress the heated surface fastener from the upper side in such a manner that the distance between the apex of the hook-shape engaging portion and the substrate sheet is defined in a predetermined size. It is however very difficult to maintain the distance in a predetermined size during this correcting.

According to the hook structure of this invention, only the hook-shape engaging portion can be corrected to a predetermined arcuate shape so that the distance between the apex of the hook-shape engaging portion and the substrate sheet surface can be kept uniform as the first reinforcing rib assumes an upright posture even when the depressing device comes into contact with the apex of the first reinforcing rib during correcting.

Furthermore, with the second reinforcing rib situated on the side surface of the base of the first reinforcing rib, when the hooks are depressed from the upper side by the substrate sheet of a companion surface having loops, even if the first reinforcing rib and the stem are bent laterally to one side or another, the base of the hook adjacent to the second reinforcing rib is kept free from bending, so that the whole of the hook is kept free from completely falling flat laterally. As a result, the loops are smoothly introduced to around the second reinforcing ribs at the bases of the hooks to reliably catch the hook-shape engaging portions inserted through the loops, thus increasing the rate of engagement.

DETAILED DESCRIPTION OF THE PREFERRED EMBODIMENTS

Figure 1:
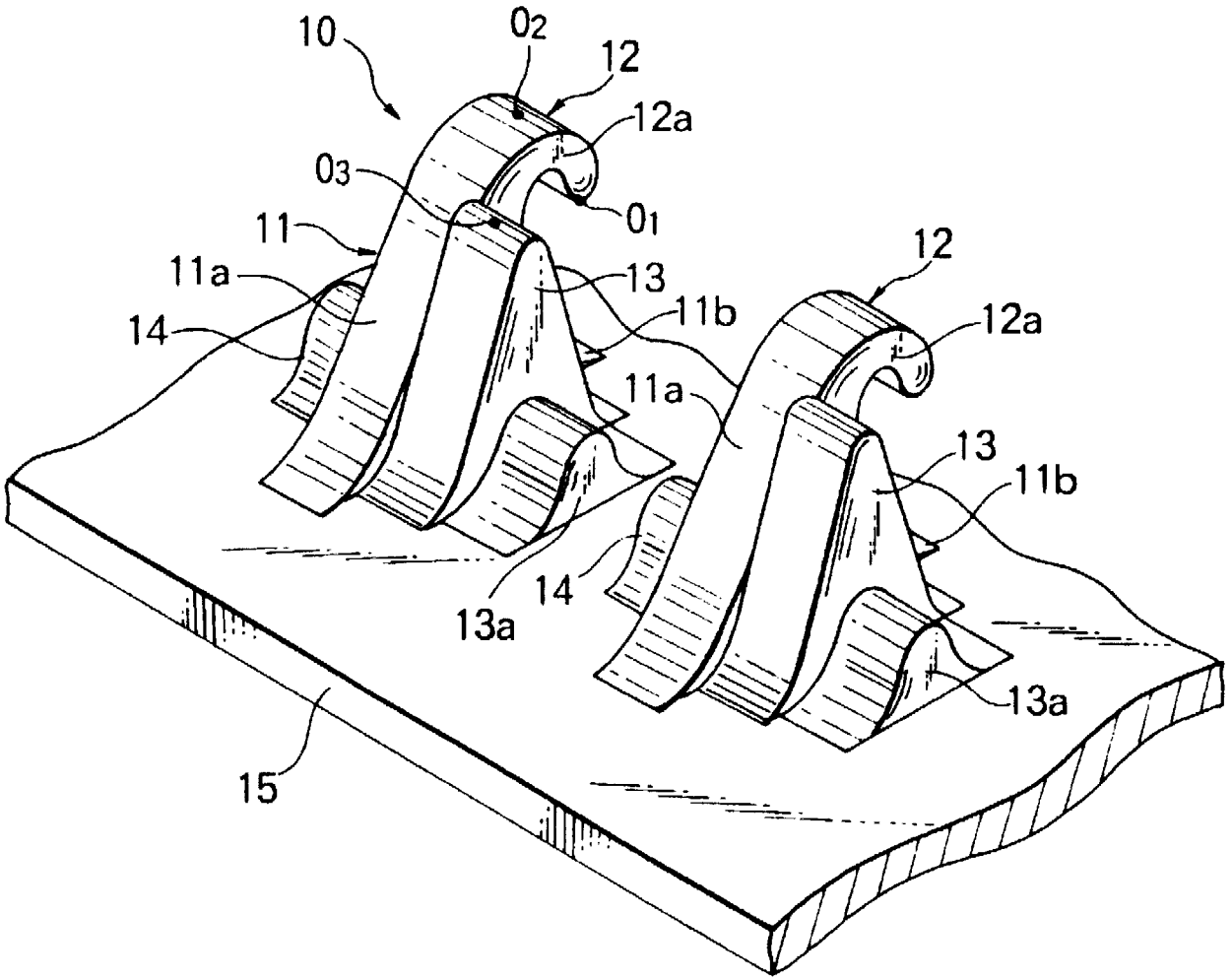
FIG. 1 is a fragmentary perspective view of a molded surface fastener, showing a hook structure and arrangement according to a typical embodiment of this invention.
Figure 2:
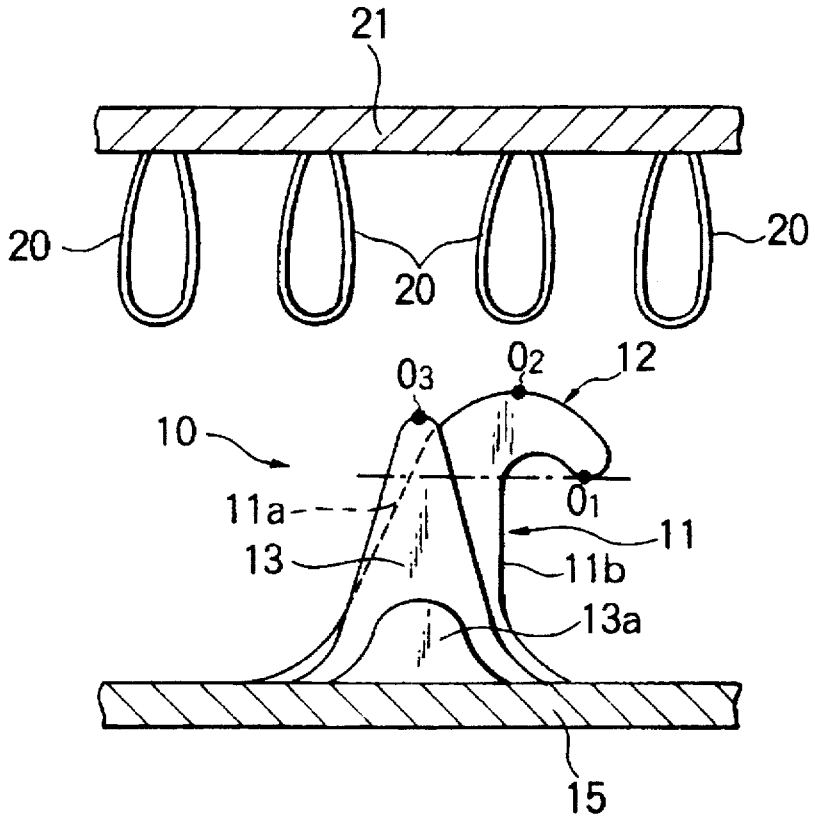
FIG. 2 is a fragmentary side view of the surface fastener, showing a hook before coming into engagement with a loop of a companion surface fastener.
Figure 3:
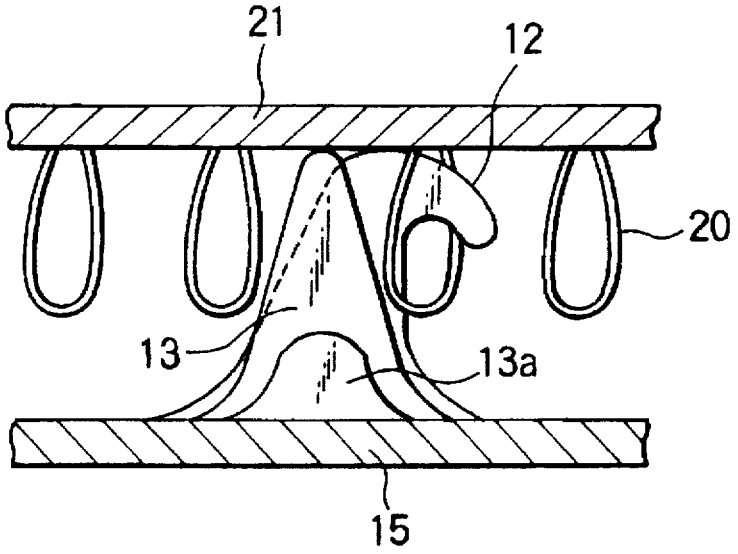
FIG. 3 is a fragmentary side view similar to FIG. 2, but showing the hook in engagement with a loop of the companion surface fastener.

Preferred embodiments of this invention will now be described in detail with reference to the accompanying drawings. FIG. 1 is a fragmentary perspective view of a molded surface fastener, showing a hook structure according to a typical embodiment of this invention. FIG. 2 is a fragmentary side view of the surface fastener of FIG. 1, showing a hook before coming into engagement with a loop of a companion surface fastener. FIG. 3 is a fragmentary side view similar to FIG. 2, but showing a hook in engagement with a loop of the companion surface fastener.

As shown in FIGS. 1 through 3, a hook 10 has a stem 11, which has a rear surface 11*a* rising obliquely in a smooth curve from a substrate sheet 15 and a front surface 11*b* rising upwardly from the substrate sheet 15, and a hook-shape engaging portion 12 extending forwardly and curving downwardly from a distal end of the stem 11.

Further, the hook 10 has on one side surface a first reinforcing rib 13 perpendicularly rising with respect to a base of the stem 11 and the hook-shape engaging portion 12.

Specifically, an apex $O_3$ of the first reinforcing rib 13 which is a characteristic feature of this invention, projects upwardly with respect to the rear surface of the hook-shape engaging portion 12 to a predetermined extent. The height of the apex $O_3$ of the first reinforcing rib 13 is defined to be smaller than the height of an apex $O_2$ of the hook-shape engaging portion 12. The apex $O_3$ of the first reinforcing rib 13 is situated above a line tangential to the hook-shape engaging portion 12 at the tip $O_1$ and substantially parallel to the upper surface of the substrate sheet 15. The apex $O_3$ is located at a free end of the reinforcing rib 13. A portion of the reinforcing rib 13, particularly the free end having the apex $O_3$, is not completely connected to the stem 11 and the hook-shape engaging portion 12. In this manner, the reinforcing rib 13 diverges from the stem 11 because the entire reinforcing rib is not connected to the stem 11 or the hook-shape portion 12. In the illustrated example, the first reinforcing rib 13 rises obliquely and arcuately on its front and rear sides substantially centrally with respect to the base of the stem 11 and terminates in an arcuate upper end to assume an equilateral triangle. Further, the first reinforcing rib 13 has on one side surface a second reinforcing rib 13*a* terminating far short of the upper end of the first reinforcing rib 13. In addition, a third reinforcing rib 14 is disposed adjacent to the other side surface of the stem 11 of the hook 10. The third reinforcing rib 14 has the same shape as the second reinforcing rib 13*a*, which has a mount-like shape with its top surface being arcuate.

The function of the hook structure of this invention will now be described using FIGS. 2 and 3. In the presence of the reinforcing ribs 13, 13*a*, 14, as a matter of course the hook 10 is prevented from falling flat laterally. Also when the hooks 10 are depressed from the upper side by a substrate sheet 21 of a companion surface fastener having loops 20, the hook-shape engaging portion 12 is initially inclined slightly forwardly until the substrate sheet 21 comes into contact with the apex $O_3$ of the first reinforcing rib 13, and thereafter the first reinforcing rib 13 supports the substrate sheet 21 to prevent the hook-shape engaging portion 12 from further inclination, maintaining the hook 10 in engaging with the loop 20. The hook-shape engaging portion 12 as slightly forwardly inclined becomes smaller in radius of curvature to catch the loop 20 more reliably than usual.

The first reinforcing rib 13 is effective also in the production of a molded surface fastener having the hook structure of this invention. Specifically, when the hooks molded integrally with the substrate sheet are removed off the mold cavities in the peripheral surface of the rotary drum as the drum is rotated, the hook-shape engaging portion of the individual hook is removed substantially straight. As a result, after this removing, the hook-shape engaging portions do not restore their arcuate shape same as the shape of the cavities and have a slightly straight shape. In an attempt to correct such a hook shape into a desired arcuate shape, it has been a conventional practice to heat the surface fastener after molding and to depress the heated surface fastener from the upper side in such a manner that the distance between the apex of the hook-shape engaging portion and the substrate sheet is defined in a predetermined size. Consequently, meticulous control technology is required for maintaining the distance in a predetermined size during this correcting.

According to the hook structure of this invention, only the hook-shape engaging portion 12 can be corrected to a predetermined arcuate shape as the first reinforcing rib 13 assumes an upright posture when the depressing device comes into contact with the apex of the first reinforcing rib 13 during correcting.

Furthermore, with the second reinforcing rib 13*a* on the side surface of the base of the first reinforcing rib 13, when the hooks 10 are depressed from the upper side by the substrate sheet 21 of a companion surface having loops 20, even if the first reinforcing rib 13 and the stem 11 are bent laterally to one side or another, the base of the hook adjacent to the second reinforcing rib 13*a* is kept free from bending, so that the whole of the hook 10 is kept free from completely falling flat laterally. As a result, the loops 20 are smoothly introduced to around the second reinforcing ribs 13*a* at the bases of the hooks 10 to reliably catch the hook-shape engaging portions 12 inserted through the loops 20, thus increasing the rate of engagement.

With the first reinforcing rib 13, even when the hook 10 is reduced in thickness with a height smaller than 1 mm, for example, the hook 10 can be adequately durable for practical use.

Figure 14:
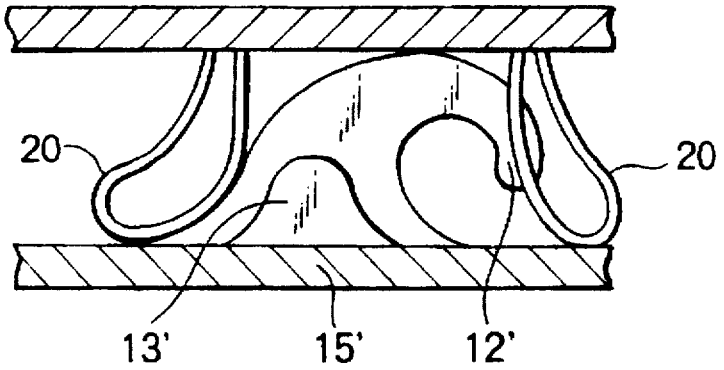
FIG. 14 is a fragmentary side view of the conventional surface fastener of FIG. 13, showing the hook in engagement with a loop of the companion surface fastener.

On the contrary, in the prior art hook structure disclosed in U.S. Pat. No. 5,131,119, when the hooks are depressed from the upper side by a companion surface fastener having loops as engaging elements, the hook-shape engaging portion together with the stem will fall laterally at once from the upper end of the reinforcing rib to bump off the loop to be engaged so that no engagement with the loop can be achieved, or, as shown in FIG. 14, the whole of the hook 10' will fall flat forwardly to make the opening of the hook-shape engaging portion 12' narrow so that no engagement with the loop 20 can be allowed. In the prior art hook structure disclosed in U.S. Pat. No. 5,339,499, when the hooks are depressed by the loops with the respective reinforcing rib having a predetermined degree of flexibility, it is impossible to estimate the position from which the reinforcing rib will fall laterally, and as a result, many of the ribs tend to fall laterally from their bases. In such event, like the above-mentioned hooks, it is highly likely that the loops to be engaged, like the hooks, will be bumped off sideways due to the bending force, and even the loops in engagement with the hook-shape engaging portions are not introduced to the bases of the hooks and will therefore come out of engagement with the hooks.

FIGS. 4 through 9 show various modifications of the hook structure of the foregoing embodiment. Parts or elements corresponding to those of the embodiment of FIG. 1 are designated by like reference numerals in FIGS. 4 through 9.

Figure 4:
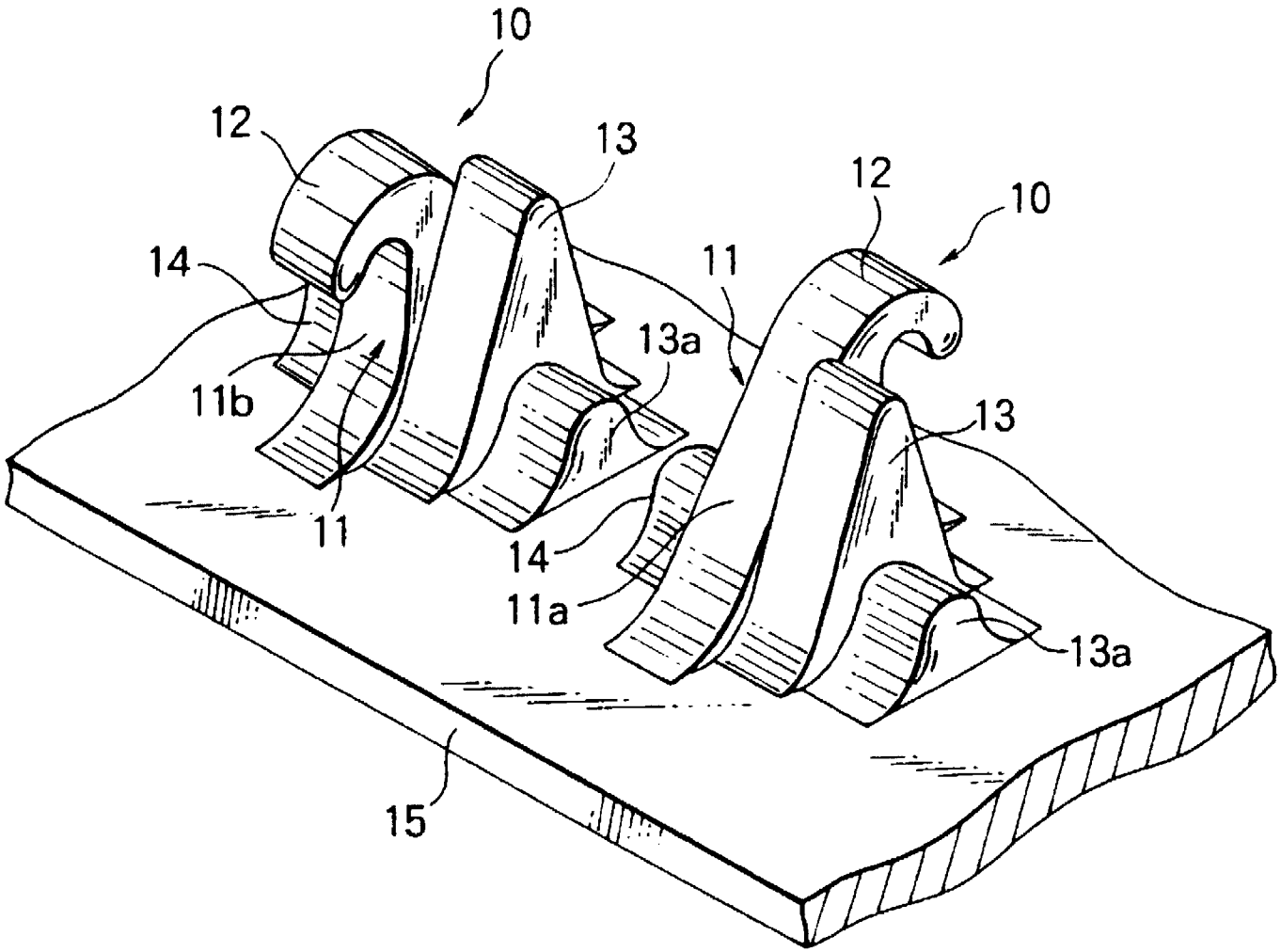
FIG. 4 is a fragmentary perspective view similar to FIG. 1, but showing a first modification of the hook.
Figure 5:
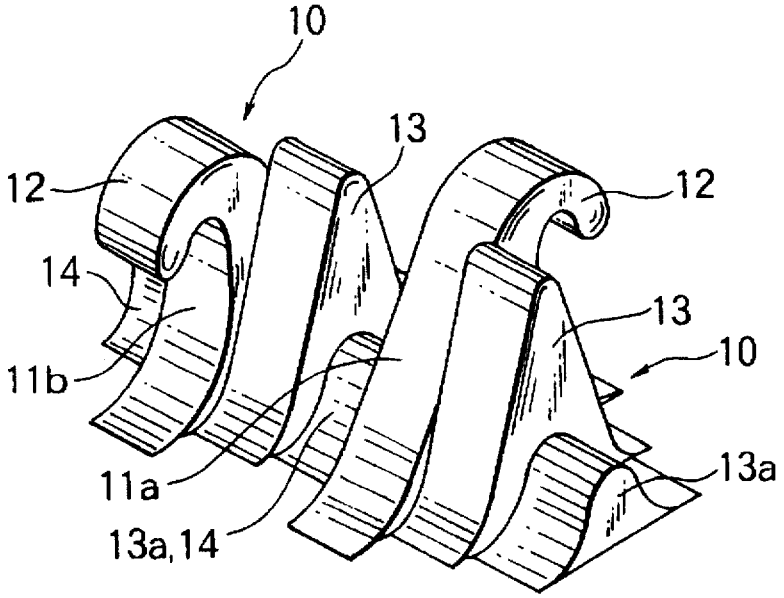
FIG. 5 is a fragmentary perspective view showing a second modification of the hook.

In the modification of FIG. 4, the structure of the individual hook 10 is identical with that of the embodiment of FIG. 1 except that the hooks 10 in an adjacent pair of rows orient in opposite directions so as not to give any directivity of engagement to the surface fastener. In the modification of FIG. 5, the second and third reinforcing ribs 13*a*, 14 of the adjacent hooks 10, 10 of FIG. 4 are joined integrally with each other so that the substrate sheet is prevented from being torn between hook rows.

Figure 6:
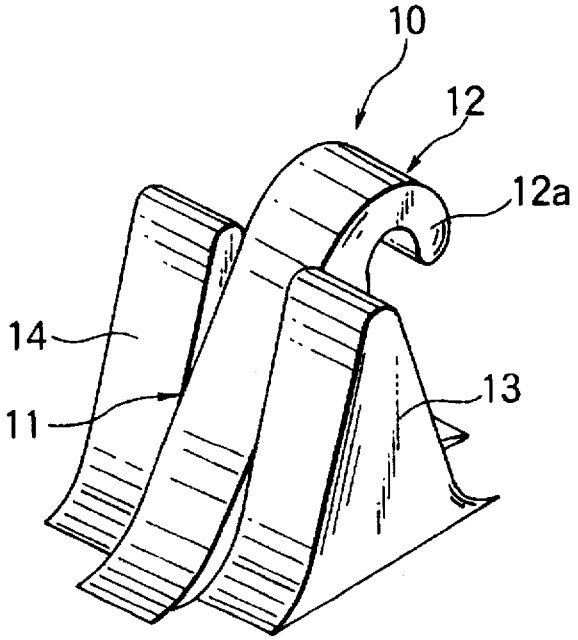
FIG. 6 is a fragmentary perspective view showing a third modification of the hook.

According to the modification of FIG. 6, in the embodiment of FIG. 1, the second reinforcing ribs 13*a* are omitted while the shape of the third reinforcing ribs 14 is identical with that of the first reinforcing ribs 13. The resulting hook structure is equivalent to the hook structure having on each of opposite side surfaces the first reinforcing rib 13 extending upwardly from adjacent to the base beyond the rear surface 11*a* of the stem 11, not only giving adequate softness to the hook-engaging portion 12 of the hook 10 but also reliably preventing the hook 10 from being flexed either longitudinally or transversely of the hook row.

Figure 7:
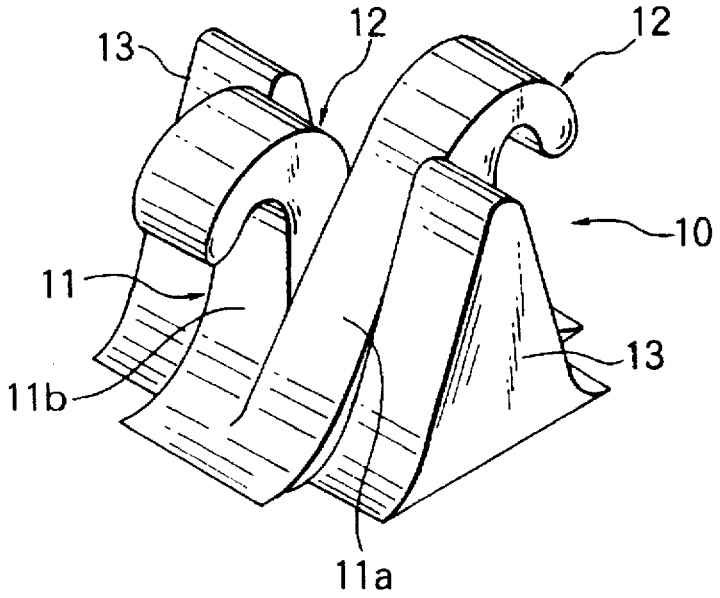
FIG. 7 is a fragmentary perspective view showing a fourth modification of the hook.
Figure 8:
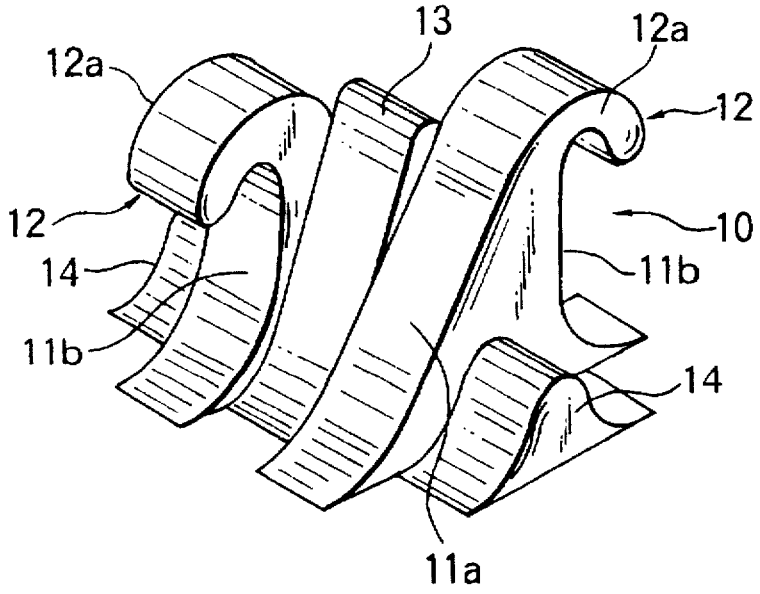
FIG. 8 is a fragmentary perspective view showing a fifth modification of the hook.
Figure 9:
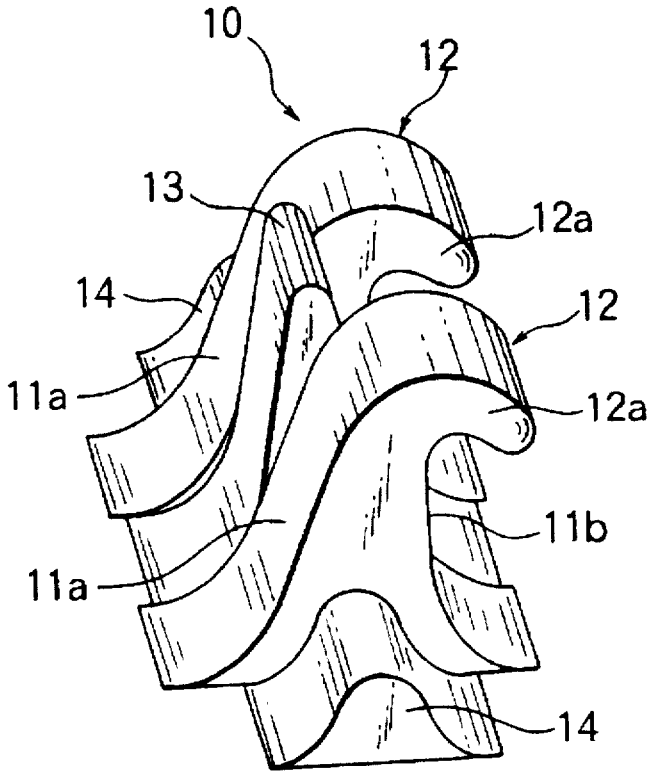
FIG. 9 is a fragmentary perspective view showing a sixth modification of the hook.

In the modification of FIG. 7, each adjacent pair of hooks has two mutually oppositely directed hook-shape engaging portions 12, 12 and two first reinforcing ribs 13, 13 formed on the respective side surfaces of two stems 11, 11. In the modification of FIG. 8, each adjacent pair of hooks has two mutually oppositely directed hook-shape engaging portions 12, 12, with two third reinforcing ribs 14, 14 formed on the respective side surfaces of two stems 11, 11, and one first reinforcing rib 13 formed between the two stems 11, 11. In the modification of FIG. 9, each adjacent pair of hooks has two hook-shape engaging portions 12, 12 directed the same, two third reinforcing ribs 14, 14 formed on the respective side surfaces of two stems 11, 11, and one first reinforcing rib 13 connecting the two stems 11, 11.

Figure 10:
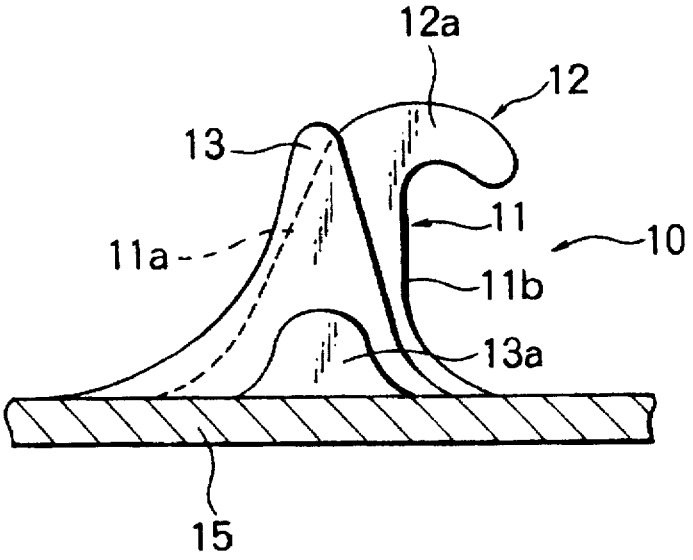
FIG. 10 is a fragmentary side view showing a seventh modification of the hook.

In the foregoing embodiment and modifications, the shape of the first reinforcing rib 13 is a generally equilateral triangle. Alternatively, as shown in FIG. 10, the first reinforcing rib 13 is expanded rearwardly beyond the rear surface 11*a* of the stem 11 so that the hook 10 is further prevented from forward inclination and that the loop (not shown) located rearwardly of the first reinforcing rib 13 comes close to a succeeding hook 10 along the rear surface of the first reinforcing rib 13, facilitating engaging.

Figure 11:
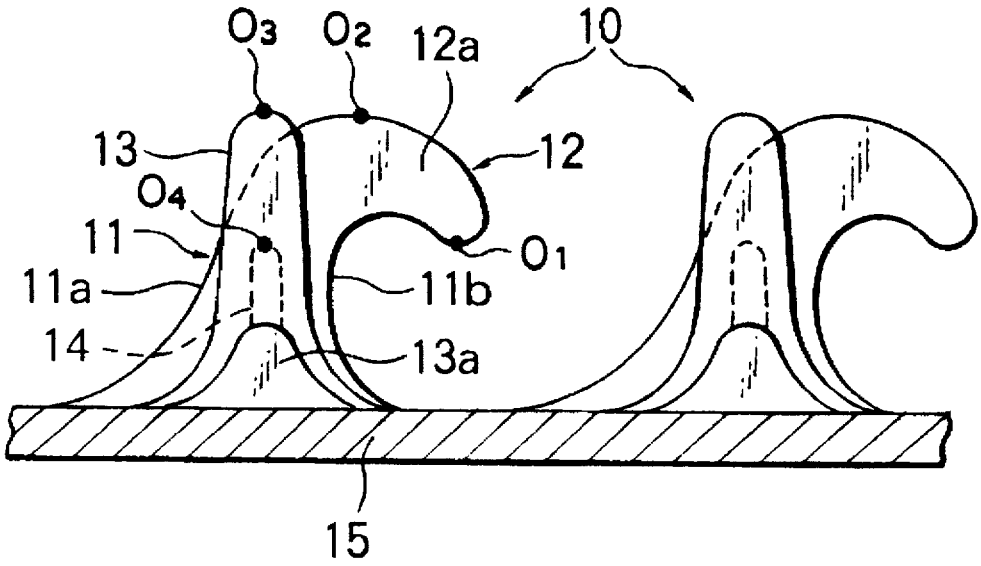
FIG. 11 is a fragmentary side view of a molded surface fastener, showing a hook structure and arrangement according to another typical embodiment of the invention.

FIG. 11 shows a hook structure according to another typical embodiment of this invention. In the hook structure of FIG. 11, the width of the first reinforcing rib 13 is reduced, and the height of the apex $O_3$ of the first reinforcing rib 13 is equal to that of the apex $O_2$ of the hook-shape engaging portion 12. And the third reinforcing rib 14 is extended perpendicularly upwardly, and the height of the apex $O_4$ of the third reinforcing rib 14 is equal to that of the tip $O_1$ of the hook-shape engaging portion 12. Alternatively, the height of the third reinforcing rib 14 may be arbitrarily determined within a range between the above-mentioned height and such a height that the upper end of the third reinforcing rib 14 reaches the rear surface of the hook-shape engaging portion 12. With this design of the third reinforcing rib 14, internal stress to occur in the hook during the engaging and peeling of the surface fastener disperses, without locally concentrating, so that the hook will hardly be damaged even due to repeated load.

Figure 12:
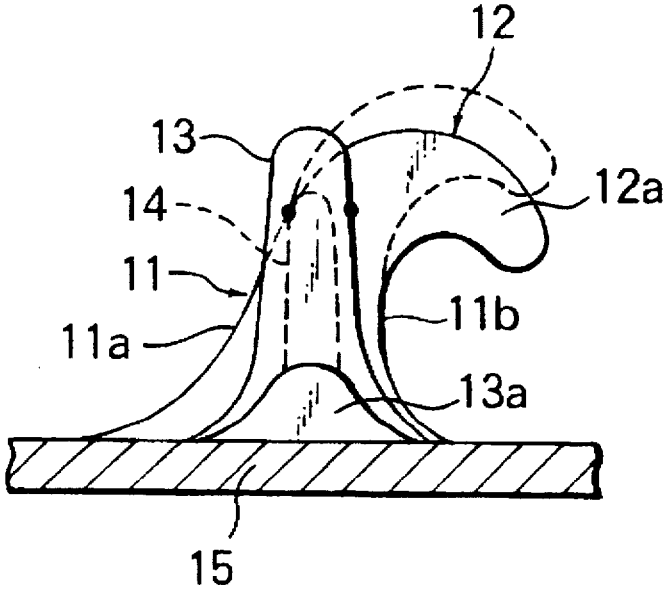
FIG. 12 is a fragmentary side view showing a modification of the hook of FIG. 12.
Figure 13:
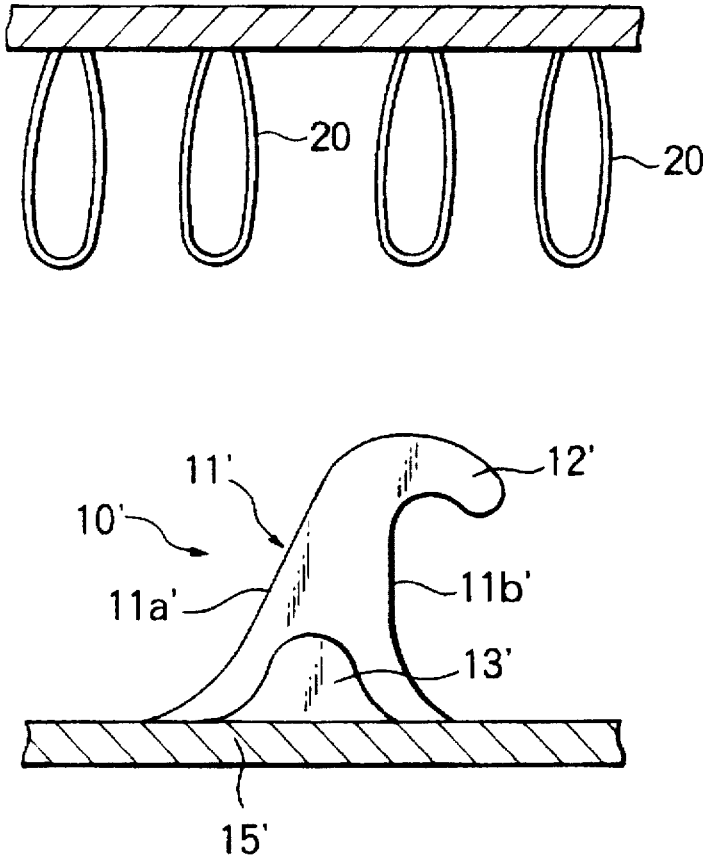
FIG. 13 is a fragmentary side view of a typical conventional molded surface fastener, showing a hook before coming into engagement with a loop of a companion surface fastener.

In FIG. 12, the shape of the hook-shape engaging portion during removing from the mold is indicated by dotted lines, and the shape during correcting process by depressing after the molding is indicated by solid lines. Since the pressure to act on the hook-shape engaging portion 12 during correcting is blocked by the first reinforcing rib 13, the hook-shape engaging portion 12 is free from further deformation than indicated by solid lines so that the shape of the hook-shape engaging portion 12 and the height of the entire hook 10 can be made uniform.

In this invention, various kinds of hook structure can be proposed by using the first, second and third reinforcing ribs 13, 13*a*, 14 in combination, and by changing their shapes. Though having minor functional differences depending on the combination and rib shape, these hook structures have above-described common essential functions, and a desired function may be obtained by varying the thickness of the stem 11 and/or the hook-shape engaging portion 12, thus meeting a wide range of requirements.

As is apparent from the foregoing description, according to the hook structure of this invention, since the upper end of the upright first reinforcing rib 13 is lower than the apex $O_2$ of the hook-shape engaging portion 12 and higher than the tip $O_1$ of the hook-shape engaging portion 12 and projects upwardly with respect to the rear surface of the hook-shape engaging portion 12, it is possible to prevent the hook-shape engaging portion 12 from falling laterally, while maintaining adequate softness of the hook-shape engaging portion 12. At the same time, during engaging with a loop 20 of the companion surface fastener, the apex $O_3$ of the first reinforcing rib 13 supports the substrate sheet 21 of the companion surface fastener to prevent the hook 10 from unnecessary forward inclination, thus securing a required rate of engagement with loops 20. Further, partly since the upper end of the first reinforcing rib 13 is taper and partly since its apex $O_3$ has a height shorter than the apex $O_2$ of the hook-shape engaging portion 12, there is no fear that the first reinforcing rib 13 might pierce the substrate sheet 21 of the companion surface fastener, keeping the companion substrate sheet 15 free from any damage.

In the presence of the first reinforcing rib 13, the hook-shape engaging portion 12 becomes hard to stand to some extent so that an increased degree of engaging strength can be achieved to eliminate breakage due to fatigue of the hook 10, securing a predetermined peeling strength of the surface fastener. Further, even when the shape of curve of the hook-shape engaging portion 12 is corrected by depressing after the surface fastener having the hook structure of this invention is molded, it is possible to keep the arcuate shape of the hook-shape engaging portion 12 uniform all the time.

The invention claimed is:

1. A molded surface fastener comprising:

(a) a substrate sheet; and (b) a multiplicity of hooks molded on and projecting from one surface of said substrate sheet;

(c) each of said hooks being composed of i) a stem having a rear surface rising obliquely in a smooth curve from said substrate sheet and a front surface rising upwardly from said substrate sheet, ii) a hook-shape engaging portion extending in a curve forwardly from a distal end of said stem, and iii) a first reinforcing rib situated on at least one side surface of said hook, said first reinforcing rib rising perpendicularly from said substrate sheet;

(d) said first reinforcing rib projecting upwardly to a free end having an apex located above a rear surface of said hook-shape engaging portion, said apex of said reinforcing rib having a height less than or at most equal to that of an apex of said hook-shape engaging portion.

2. A molded surface fastener according to claim 1, wherein the said apex of said first reinforcing rib is situated above a line tangential to the hook-shape engaging portion at the tip and substantially parallel to the upper surface of the substrate sheet.

3. A molded surface fastener according to claim 1, wherein each of said hooks has a second reinforcing rib situated at the base end of said first reinforcing rib and having a height less than that of said first reinforcing rib.

4. A molded surface fastener according to claim 1, wherein each of said hooks has a further reinforcing rib situated at another side surface of said stem.

5. A molded surface fastener according to claim 4, wherein every adjacent pair of said hooks is connected with each other by part of said first reinforcing rib.

6. A molded surface fastener comprising:

(a) a substrate sheet; and (b) a multiplicity of hooks molded on and projecting from one surface of said substrate sheet;

(c) each of said hooks being composed of i) a stem having a rear surface rising obliquely in a smooth curve from said substrate sheet and a front surface rising upwardly from said substrate sheet, ii) a hook-shape engaging portion extending in a curve forwardly from a distal end of said stem, and iii) a first reinforcing rib situated on at least one side surface of said hook, said first reinforcing rib rising perpendicularly from said substrate sheet;

(d) said first reinforcing rib has an apex projecting upwardly with respect to a rear surface of said hook-shape engaging portion, said apex of said reinforcing rib having a height less than or at most equal to that of an apex of said hook-shape engaging portion;

wherein each of said hooks has a second reinforcing rib situated at the base end of said first reinforcing rib and having a height less than that of said first reinforcing rib; and wherein each of said hooks has a third reinforcing rib situated at another side surface of said stem.

7. A molded surface fastener comprising:

(a) a substrate sheet; and (b) a multiplicity of hooks molded on and projecting from one surface of said substrate sheet;

(c) each of said hooks being composed of i) a stem having a rear surface rising obliquely in a smooth curve from said substrate sheet and a front surface rising upwardly from said substrate sheet, ii) a hook-shape engaging portion extending in a curve forwardly from a distal end of said stem, and iii) a first reinforcing rib situated on at least one side surface of said hook, said first reinforcing rib rising, perpendicularly from said substrate sheet;

(d) said first reinforcing rib has an apex projecting upwardly with respect to a rear surface of said hook-shape engaging portion, said apex of said reinforcing rib having a height less than or at most equal to that of an apex of said hook-shape engaging portion;

wherein each of said hooks has a further reinforcing rib situated at another side surface of said stem;

wherein each of said hooks has a second reinforcing rib situated at the base end of said first reinforcing rib and having a height less than that of said first reinforcing rib, wherein every adjacent pair of said hooks is connected with each other by part of said second and further reinforcing ribs.

8. A molded surface fastener comprising:

(a) a substrate sheet; and (b) a multiplicity of hooks molded on and projecting from one surface of said substrate sheet;

(c) each of said hooks being composed of a stem having a rear surface rising obliquely in a smooth curve from said substrate sheet and a front surface rising upwardly from said substrate sheet, a hook-shape engaging portion extending in a curve forwardly from a distal end of said stem, and a first reinforcing rib situated on a first side surface of said hook, said first reinforcing rib rising perpendicularly from said substrate sheet;

(d) said first reinforcing rib projecting upwardly to diverge from said stem, extending to a free end having an apex at a top thereof, said apex of said reinforcing rib having a height less than or at most equal to that of an apex of said hook-shape engaging portion.

9. A molded surface fastener according to claim 8, wherein the said apex of said first reinforcing rib is situated above a line tangential to the hook-shape engaging portion at the tip and substantially parallel to the upper surface of the substrate sheet.

10. A molded surface fastener according to claim 8, wherein each of said hooks has a second reinforcing rib situated at the base end of said first reinforcing rib and having a height less than that of said first reinforcing rib.

11. A molded surface fastener according to claim 8, wherein each of said hooks has a further reinforcing rib situated at another side surface of said stem.

* * * * *